US005743796A

United States Patent [19]

Orak et al.

[11] Patent Number: 5,743,796

[45] Date of Patent: Apr. 28, 1998

[54] ELECTRONIC GAME

[75] Inventors: Zeki Orak, San Francisco; Dan Klitsner, Larkspur, both of Calif.

[73] Assignee: Tiger Electronics, Inc., Vernon Hills, Ill.

[21] Appl. No.: 586,064

[22] Filed: Jan. 16, 1996

[51] Int. Cl.[6] ..... A63F 9/24

[52] U.S. Cl. ..... 463/9; 273/271; 273/237

[58] Field of Search ..... 273/236–238, 273/260, 271, 429; 463/1, 9–10, 14, 30–31, 35, 36–37, 46; 364/410, 411

[56] References Cited

U.S. PATENT DOCUMENTS

| | | | |
|---|---|---|---|
| 3,367,663 | 2/1968 | Marks | 273/135 |
| 4,006,903 | 2/1977 | Barish | 273/130 AB |
| 4,017,081 | 4/1977 | Windisch | 273/138 A |
| 4,019,745 | 4/1977 | Mustelier | 463/14 |
| 4,184,676 | 1/1980 | Barish | 273/237 |
| 4,275,442 | 6/1981 | Underwood et al. | 364/410 |
| 4,355,806 | 10/1982 | Buck et al. | 463/35 |
| 5,013,047 | 5/1991 | Schwab | 273/238 |
| 5,095,798 | 3/1992 | Okada et al. | 463/35 |
| 5,129,654 | 7/1992 | Bogner | 273/260 |
| 5,248,149 | 9/1993 | Tarrats | 273/271 |
| 5,351,965 | 10/1994 | Telfer et al. | 273/260 |
| 5,417,425 | 5/1995 | Blumberg et al. | 273/153 R |

*Primary Examiner*—Jessica Harrison
*Assistant Examiner*—Mark A. Sager
*Attorney, Agent, or Firm*—Fitch, Even, Tabin & Flannery

[57] ABSTRACT

A game having a housing with a plurality of spaces on the exterior of the housing. Each of the spaces has an input device and an indicator corresponding to the space, and each indicator has an off state and a plurality of distinct player states. Inside the housing is a controller which communicates with each of the input devices and indicators. The controller limits the number of indicators indicating each one of said distinct player states to a predetermined number. The predetermined number is less than half of the number of spaces on the exterior of the housing.

12 Claims, 7 Drawing Sheets

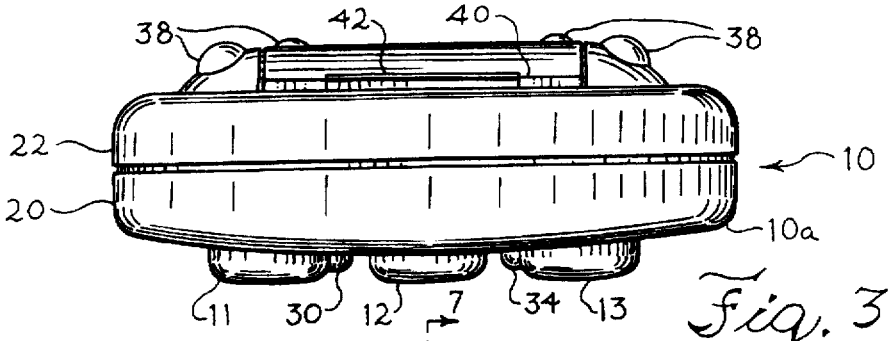
Fig. 3
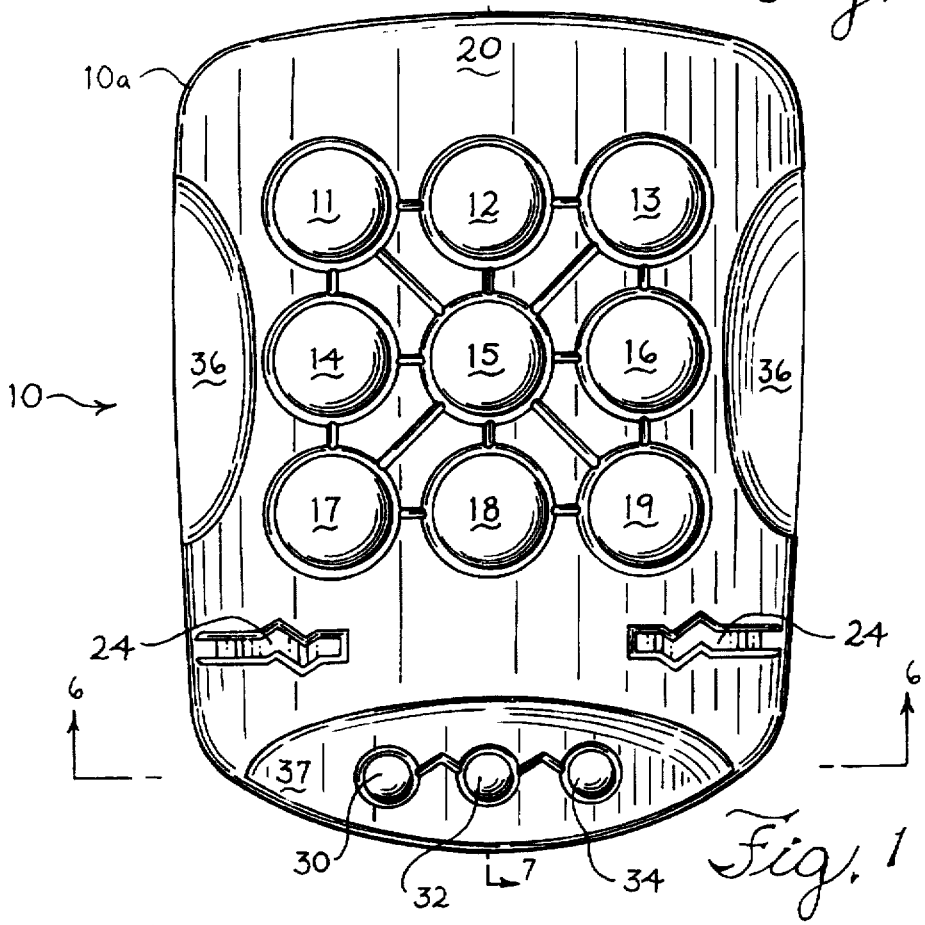
Fig. 1
Fig. 2
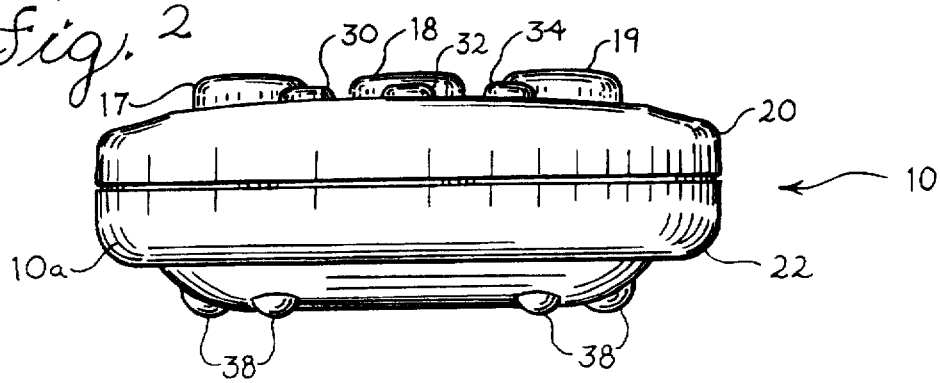

Q3 9013
Q4 9013
Q5 9013
Q6 9013
RESISTORS B 2×3
RESISTORS B 2×3
RESISTORS B 2×3
RESISTORS B 2×2
90b
92a
94a
92b
94b
90a
VCC
Q15 8550
G 1
R
G 2
R
G 3
R
Q16 8550
96a
96b
98a
98b
100a
100b
Q17 8550
G 4
R
G 5
R
G 6
R
TO FIG. 9A
Q18 8550
102a
104a
104b
106a
106b
Q19 8550
102b
G 7
R
G 8
R
G 9
R
Q20 8550
122
108a
108b
G P1
R P2

ELECTRONIC GAME

BACKGROUND OF THE INVENTION

This invention relates to games, and more particularly to a game wherein each player attempts to align a preset number of indicators assigned to him within an array of spaces.

The game of tic-tac-toe is well-known. Two players alternate placing symbols, usually X and 0, into square spaces of a three-by-three array until one of the two players aligns three of his symbols horizontally, vertically, or diagonally within the array to win the game, or until all the spaces of the array are full. When all the spaces of the array are full and no player has achieved three aligned symbols, the game is declared a draw.

Tic-tat-toe tends to be a game primarily for children because, due to the symmetries of the three-by-three array, or playing board, and the relatively limited number of possible moves, many players learn all the possible outcomes with only a little experience. When two experienced players play against each other, they usually play to a draw, and if they each employ optimal strategies, they will always play to a draw. Thus, it is well known within the art to program a computer to play, and never lose, at tic-tac-toe.

Tic-tac-toe is therefore an enjoyable game for many younger children, but, because of its simplicity and tendency to result in draws, it does not provide comparable challenge or corresponding excitement for most older children and adults.

SUMMARY OF THE INVENTION

The inventive game reintroduces challenge and excitement for older children and adults by transcending ordinary tic-tac-toe. The inventive game prevents draws and challenges the players to remember the sequence of past moves.

The inventive game has an array of spaces, each of the spaces being able to support an indicator for indicating that the space is held by one of the players. The spaces held by different players are marked by distinct indicators. A space not held by a player has no indicator.

In a predetermined order, the players take turns selecting one empty space of the array in which to have one of their indicators placed. If the player selecting a space already has a predetermined number of his indicators in the array, he must, when selecting his next space, relinquish his hold on the space which he has held for the longest continuous period, thereby removing his indicator from the space. Thus, once each player has his predetermined number of indicators placed in the array, a held space of the array will be relinquished every time that an empty space is selected.

The players continue to select spaces in the predetermined order, relinquishing held spaces when required so as not to exceed the predetermined limit on the number of indicators, until one player wins the game by aligning some or all of his indicators within the array to conform to one of a number of predetermined winning patterns.

The inventive game, unlike tic-tac-toe, does not end in a draw if there is no winner after a fixed number of moves. In tic-tac-toe, once a symbol has been placed into the array, it remains there until the game is over. Remembering the sequence of moves is critical in the inventive game because a player's strategic selection of a space should be influenced by his knowledge of which space he will have to relinquish, and even what space his opponent(s) will next relinquish.

BRIEF DESCRIPTION OF THE DRAWINGS

FIG. 1 is a from view of a game in accordance with the invention.

FIG. 2 is a bottom view thereof.

FIG. 3 is a top view thereof.

DETAILED DESCRIPTION OF PREFERRED EMBODIMENTS

Figure 5:
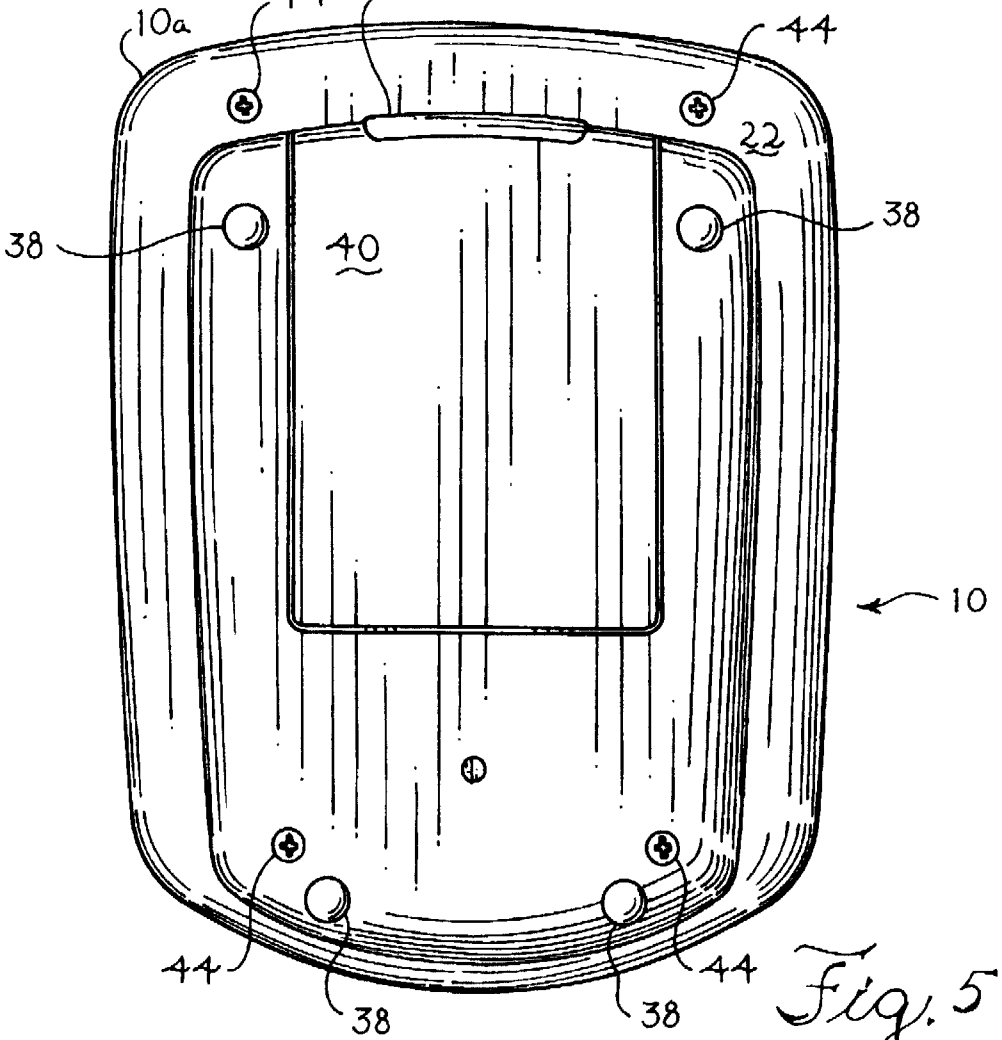
FIG. 5 is a rear view thereof.

The invention is preferably embodied in a game having a housing with a plurality of spaces on the exterior of the housing. Each of the spaces has an input device and an indicator corresponding to the space, and each indicator has an off state and a plurality of distinct player states. Inside the housing is a controller which communicates with each of the input devices and indicators. The controller limits the number of indicators indicating each one of the distinct player states to a predetermined number. The predetermined number is less than half of the number of spaces on the exterior of the housing.

The preferred embodiment of the claimed invention is an electronic game 10 for two players playing against one another, where one of the players may be a microcontroller 60. The body of the game 10 is a housing 10*a* comprising a front cover 20 and a rear cover 22, the covers fitting together along their edges.

As shown in FIG. 1 the front cover 20 has nine substantially circular openings arranged in a three-by-three square array. Nine substantially circular array buttons 11–19 are disposed within the nine openings of the array. From the front view of FIG. 1, the top-left array button 11 is in the first horizontal row and the first vertical column; the top-middle array button 12 is in the first horizontal row and the second vertical column; the top-right array button 13 is in the first horizontal row and the third vertical column; the middle-left array button 14 is in the second horizontal row and the first vertical column; the middle-middle array button 15 is in the second horizontal row and the second vertical column; the middle-right array button 16 is in the second horizontal row and the third vertical column; the bottom-left array button 17 is in the third horizontal row and the first vertical column; the bottom-middle array button 18 is in the third horizontal row and the second vertical column; and the bottom-right array button 19 is in the third horizontal row and the third vertical column.

The front cover 20 has lateral indentations 36 on the left and right sides of the cover 20 to facilitate holding the game 10 in one's hand and a bottom bulge 37. The front cover 20 also has slightly recessed player turn lights 24 which may be lit to indicate which of the two players has the next turn.

On the bottom bulge 37 of the front cover 20, there is a start button 30 for resetting the playing conditions of the game, an on/off button 32 for turning the game on and off, and a sound button 34 for toggling the sound on and off.

Figure 4:
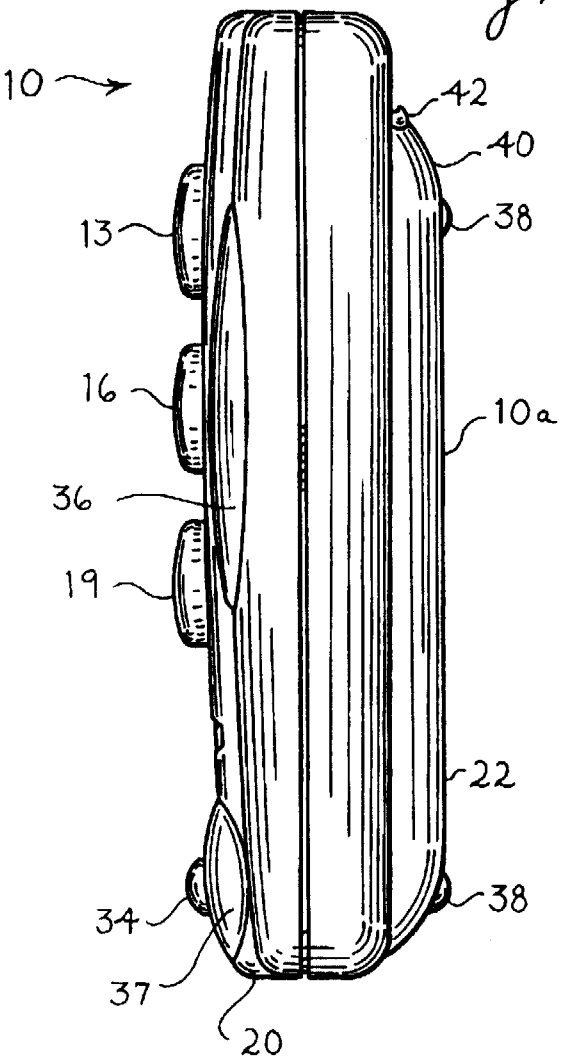
FIG. 4 is a right side view thereof.

Referring now to FIGS. 2–4, it can be seen that the array buttons 11–19, the start button 30, the on/off button 32, and the sound button 34 protrude beyond the front cover 20 so that these buttons may be easily depressed. Also, these figures show foot pads 38 affixed to the rear cover 22 for providing stability and/or friction when the game is placed on a flat surface.

Figure 6:
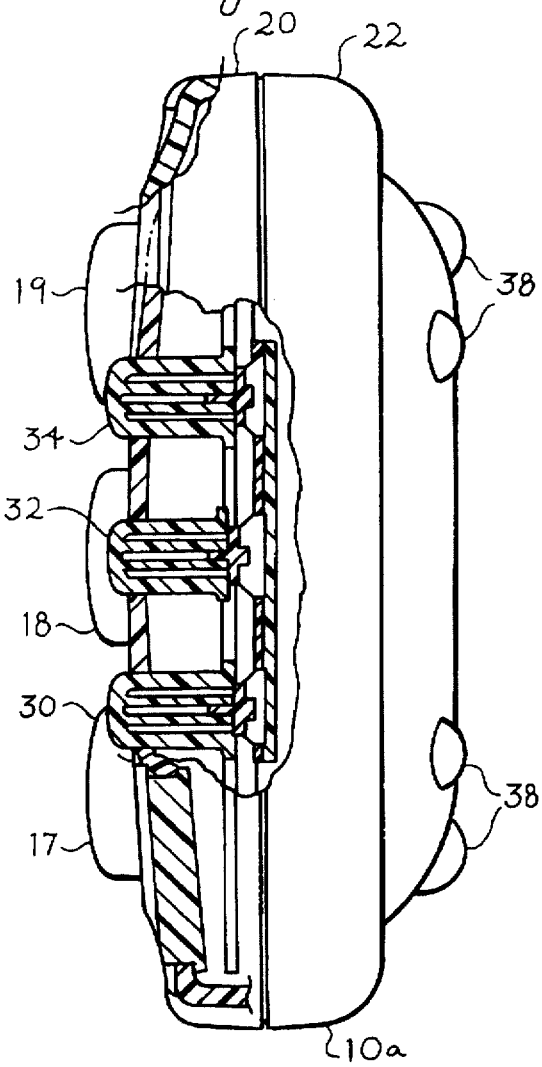
FIG. 6 is a cross-sectional view thereof taken across the line 6—6 in FIG. 1.
Figure 7:
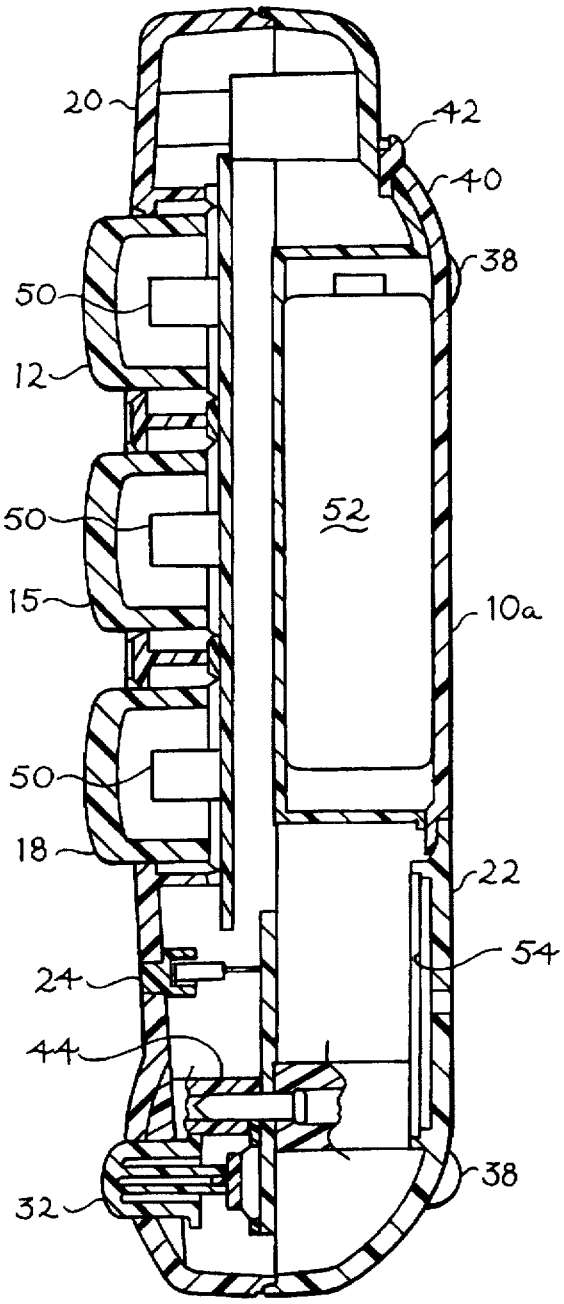
FIG. 7 is a cross-sectional view thereof taken across the broken line 7—7 in FIG. 1.

The preferred embodiment of the game is battery operated, and FIGS. 3–5 show a battery cover 40 which can be moved to permit access to and replacement of batteries 52. The battery cover 40 has a lip 42 to facilitate manual manipulation of the cover 42. FIGS. 5 and 7 also shows screws 44 which keep the front cover 20 fastened to the rear cover 22. FIGS. 6 and 7 show some of the interior of the preferred embodiment. In particular, FIG. 7 shows the indicator lights 50 disposed within the array buttons used for inputting players' selected spaces. The indicator lights 50 each have an off state, a first player state (green), and a second player state (red) in the preferred embodiment. FIG. 7 also shows a speaker 54 which is in electronic communication with the microcontroller 60 and produces sounds when the game is played.

Figure 8A:
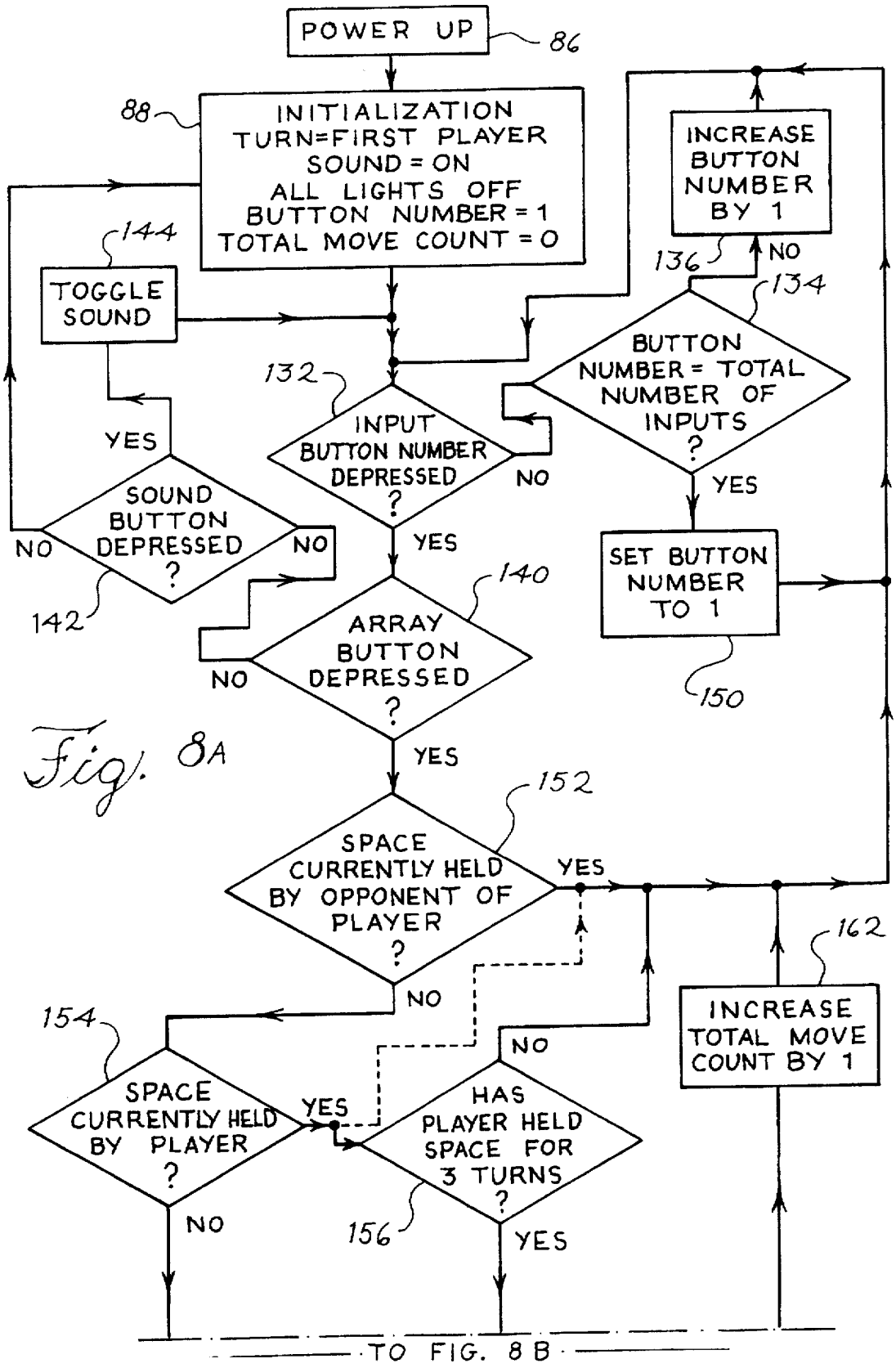
FIGS. 8A and 8B are a flow diagram detailing operation of the game.
Figure 8B:
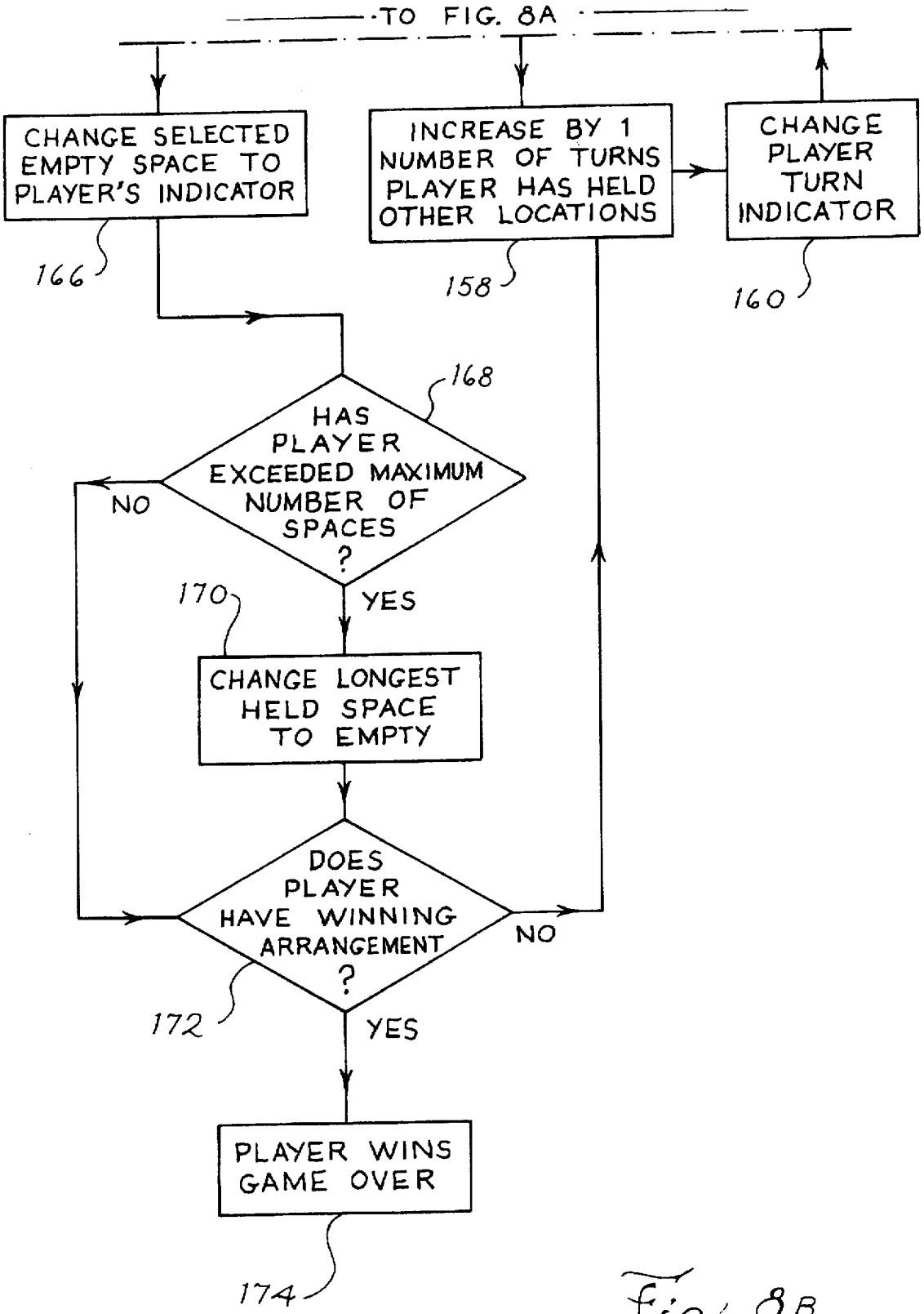
Figure 9A:
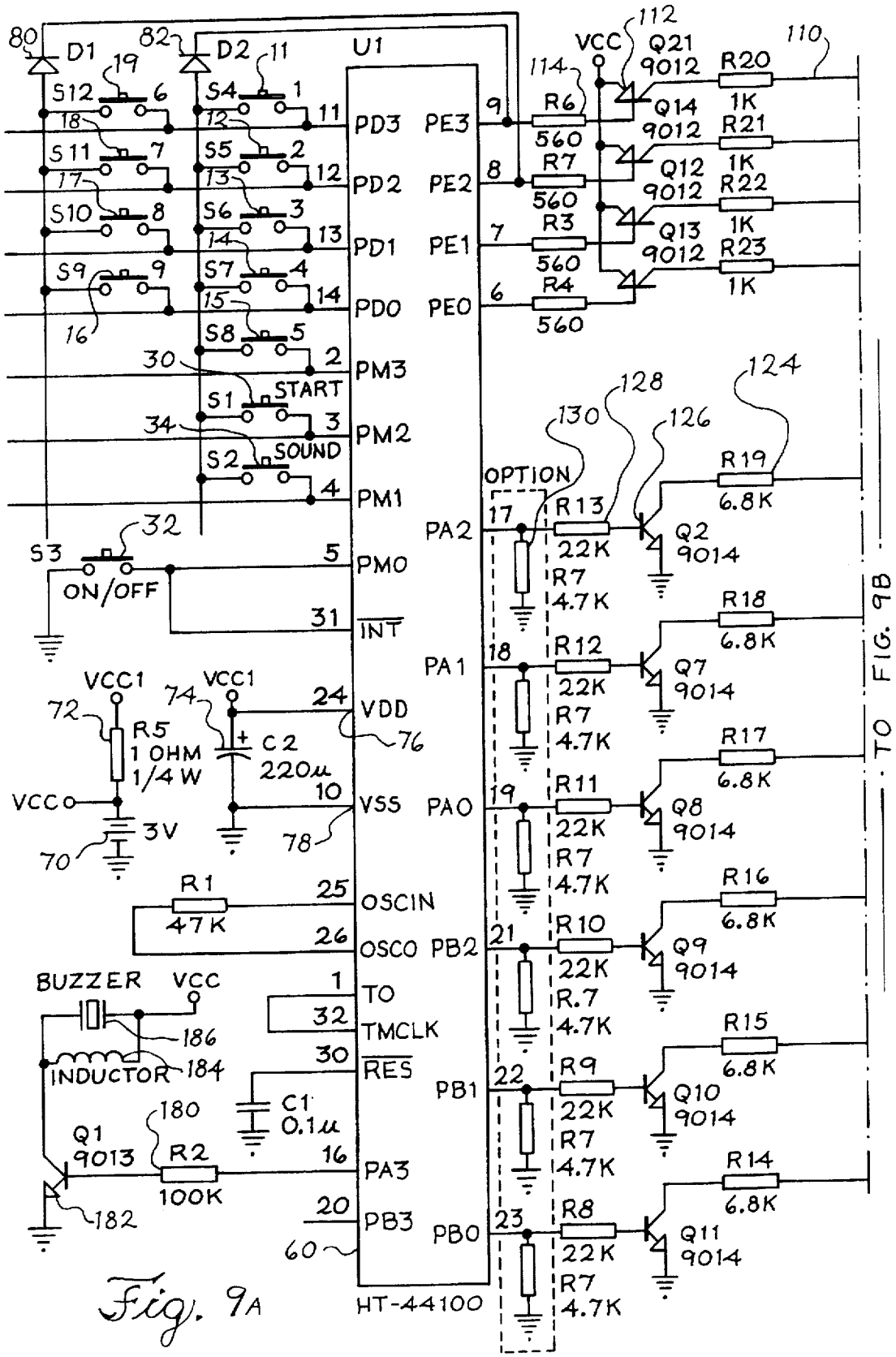
FIGS. 9A and 9B are a schematic diagram of the game.
Figure 9B:
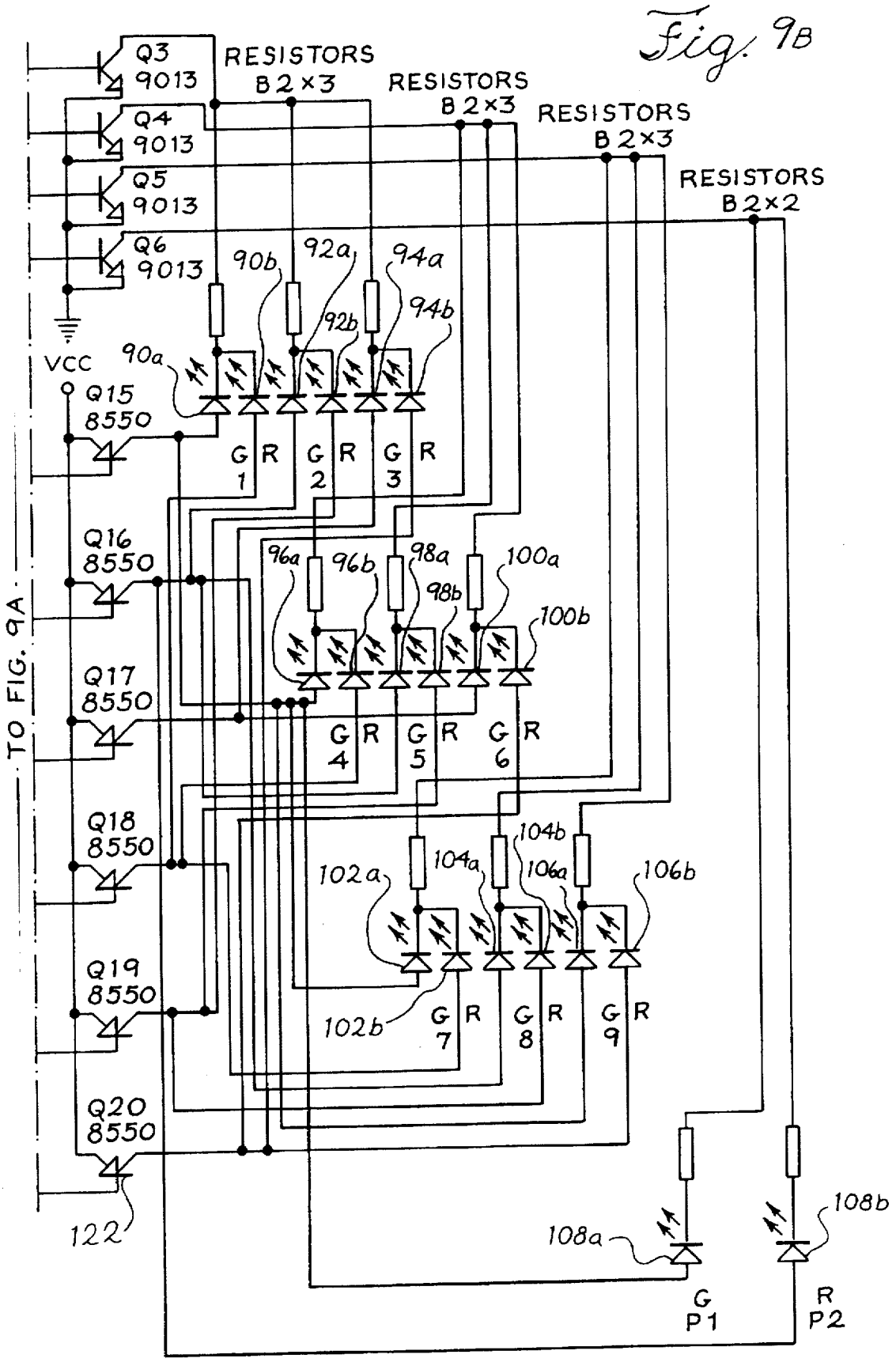

As shown in FIGS. 9A and 9B, the game 10 include the microcomputer or micro-controller 60. The microcontroller 60 includes a plurality of its pins PM1-3, PD0-3, and PE0-3, coupled to various input and output devices. In addition, pins PB0-2 and PA0-2 are coupled as output devices to illuminating indicators. In operation, the microcontroller 60 is powered from a voltage source, typically a pair of batteries 70 having a three volt potential. The battery is coupled to a resistor 72 and is grounded. The battery 70 and resistor 72 are coupled to an electrolytic capacitor 74 which is coupled across a VDD pin 76 and a VSS pin 78 of the microcontroller 60. The microcontroller 60 in this instance is an HT-44100 and includes RAM and ROM memory, the ROM memory storing the program causing the game to follow the steps set forth in the flow chart of FIGS. 8A and 8B as disclosed hereinafter. The array buttons 11–19 are coupled via a pair of diodes 80 and 82 into the inputs of the microcontroller 60. These array buttons 11–19 are scanned on a periodic basis to determine whether any have been closed. In addition, the start, on/off, and sound buttons 30, 32 and 34 are also coupled to the ports of the microcontroller 60 and are scanned similarly to the array buttons 11–19.

The microcontroller 60, is powered up in a step 86 when the on/off button 32 is closed, grounding the interrupt pin and the PM0 pin of the microcontroller 60. In a step 88, the microcontroller is initialized, first player (108*a*) is turned on, sound is switched on, and all of the lamps are switched off. These include paired green and red LED's 90*a*, 90*b*, 92*a*, 92*b*, 94*a*, 94*b*, 96*a*, 96*b*, 98*a*, 98*b*, 100*a*, 100*b*, 102*a*, 102*b*, 104*a*, 104*b*, 106*a*, 106*b*, connected through resistors to a plurality of transistors 110 connected through a second plurality of transistors 112 which are ultimately coupled at their bases through a plurality of resistors 114 to the port pins PE0-3. In addition, the LEDs are selectively enabled by a plurality of transistors 122 coupled by a plurality of resistors 124 to a second plurality of transistors 126 coupled by resistor pairs 128 and 130 to ports PB0-2 and PA0-2.

The system then sets the button number at 1, corresponding to array button 11, and the total move count at 0. Control is then transferred to a step 132 which tests to determine whether any of the array buttons 11–19 or any of buttons 30, 32, or 34 have been depressed. If they have not, control is transferred to a test step 134 which determines whether the button number is equal to the total number of inputs. If that test is in the negative, control is transferred to a step 136 which increments or increases the button number by one in order to continue to scan the buttons. Control is then transferred back to the step 132. In the event that the step 132 indicates that a button has been depressed, a test is made in the step 140 to determine whether an array button has been depressed. If it is not, control is transferred to a step 142 to test whether the sound button 34 has been depressed. If it is not, the start button 30 has been depressed and control is transferred back to the step 88. If the sound button 34 has been depressed, control is transferred to a step 144 causing the sound to be toggled, which transfers control back to the test step 132.

In the event the response to the step 134 is in the affirmative, control is transferred to a step 150, setting the button number equal to one which then transfers control back to the step 132. In the event that the result of the test made in step 140 as to whether an array button 11–19 is depressed is in the affirmative, control is then transferred to a step 152 which tests to determine whether the space or location is currently held by an opponent of the player. If it is, control is transferred back to the step 132. If it is not, control is transferred to a step 154 in which the microcontroller 60 determines whether the space is currently held by the player. In one of the preferred embodiments, if the space is currently held by the player, control is transferred to a step 156 which determines whether the player has held that space for three turns. If the player has not, control is transferred back to step 132. If the player has held the space for three turns, control is transferred to a step 158 which increments by one the number of turns the player has held the other locations. Control would then be transferred to a step 160 wherein the player turn indicator is changed to the other player, and in step 162 the total move count is incremented by one, following which control is transferred back to the step 132. In another of the preferred embodiments, if the space selected is currently held by the player, control is transferred back to step 132 without performing steps 156, 158, 160, and 162.

If, as a result of the test in step 154, the space is not currently held by the player, control is transferred to a step 166 causing the empty space to be changed to the player's indicator. For instance, one player would have all of the green LEDs 90*b*, 92*b*, 94*b*, 96*b*, 98*b*, 100*b*, 102*b*, 104*b*, and 106*b*, while the other player would have all the red LEDs 90*a* through 106*a*.

In a step 168, a test is made to determine whether the player has exceeded the maximum number of spaces. If the player has, the longest held space or LED is changed to an off state by extinguishing its LED in a step 170. If the player has not exceeded the maximum number of spaces, control is transferred to a step 172 determining whether the player has a winning arrangement of indicator lights. If the player does have a winning arrangement, control is transferred to a step 174 indicating that the player has won and causing a signal to be fed through a resistor 180 switching on a transistor 182 causing current to be drawn through an inductor 184 and a buzzer 186 causing a sound annunciation to occur. In the event that the response to step 172 is in the negative, control is then transferred back to step 158.

In the preferred embodiment of the invention, when the game is over, the microcontroller 60 flashes the winning arrangement of three indicators and then all nine indicators. Furthermore, the microcontroller keeps count of the number of wins by each player, and when one player is the first to win two separate games, the microcontroller signals the indicator lights to flash in a spiral pattern in the array in the color assigned to the winning player.

In the preferred embodiment of the invention, the electronic game 10 has two playing modes, one which may be played by one human player against another, and one in which the microcontroller 60 makes the space selections for one of the players. In the latter of these modes, the microcontroller 60 may be set on one of two skill levels for providing appropriate challenge to both novice players and expert players.

The preferred embodiment also has a 20-second timer for limiting the time since his opponent's selection in which the player must input his selection. When less than 5 seconds remain on the timer, the player's indicators repeatedly flash to alert him of the approaching time limit. If the player fails to input his selection within the 20 second period, the penalty is that he loses his turn. Thus, he is given no space for that turn, and if he would have had to relinquish a space by making a selection, he relinquishes the space despite failing to input a selection. This penalty is not cumulative, however, because upon properly selecting spaces within the time limit on three subsequent turns, the "lost" space is relinquished, restoring the player's total number of indicators to the maximum permitted.

The preferred embodiment also has a 3-minute inactivity timer wherein the controller turns off the power for playing the game when it detects that no inputs have been interacted with for a continuous three minute period.

Other preferred embodiments of the claimed invention may have additional or alternative features. In particular, another preferred embodiment of the claimed invention has six different skill levels when two players play against one another. In one skill level, the next indicator each player will relinquish is lit more dimly in the appropriate color. In another skill level, the indicators blink in sequential order. In another skill level, only one's own indicators blink in sequential order. In another skill level, each player is limited to three such hints per game. In another skill level, each player has 20 seconds to select a space without facing penalty. In another skill level, each player has only 10 seconds to select a space without facing a penalty. Combinations of these features are contemplated to be within the scope of the invention.

In the other preferred embodiment, one player may also play against the microcontroller. This embodiment has four levels for such play. In one level, the controller selects its spaces at random. In another level, the computer evaluates possible selections based on possible outcomes one complete player turn into the future. In other, more sophisticated levels, the computer evaluates based on outcomes two or three complete player turns into the future.

The other preferred embodiment also provides alternative playing modes whereby the player can play different types of games with the same hardware as provided in the inventive game. These games can include solving mazes, light pattern copying, and translation and transposition of colored squares.

The description of preferred embodiments is not meant to limit the scope of the invention to the embodiments described herein. Rather, many elements of the claimed invention have a number of alternatives which function equivalently. The scope of the invention is expressed in the following claims.

What is claimed is:

1. An electronic game comprising:

a housing having an exterior;

a plurality of spaces on said exterior of said housing;

a plurality of indicators corresponding to said spaces, each of said indicators having an off state and a plurality of distinct player states;

a plurality of input devices corresponding to said spaces for changing the state of the corresponding indicators; and an electronic controller disposed within said housing wherein said electronic controller is in electronic communication with each of said input devices and each of said indicators, and said controller is configured to change a state of an indicator from a particular player state to an off state when a number of indicators in said particular player state exceeds a predetermined number.

2. A game according to claim 1 further comprising a player turn indicator in electronic communication with said controller.

3. A game according to claim 1 further comprising a speaker in electronic communication with said controller for producing sounds when said game is played.

4. A game according to claim 3 further comprising a sound input device for activating and deactivating said speaker.

5. A game according to claim 1 wherein said plurality of spaces is rectangularly arrayed on said exterior of said housing.

6. A game according to claim 5 wherein said rectangular array comprises nine spaces arranged in three rows and three columns.

7. A game according to claim 6 wherein each of said indicators has an off state and exactly two distinct player states, and said controller limits the number of indicators indicating each of said two distinct player states to three.

8. A game according to claim 7 wherein each of said input devices comprises a button disposed substantially within the space corresponding to said input device.

9. A game according to claim 8 wherein each of said indicators is disposed within the button corresponding to the space corresponding to said indicator.

10. A game according to claim 9 wherein each of said indicators indicates said first player state by emitting light of a first color and indicates said second player state by emitting light of a second color distinct from said first color.

11. An electronic game comprising:

a housing having an exterior;

a plurality of spaces on said exterior of said housing;

means corresponding to each of said spaces for indicating an off state and a plurality of distinct player states;

means corresponding to each of said spaces for changing a state of the corresponding indicating means; and controller means disposed within said housing wherein said controller means is in communication with each of said changing means and each of said indicating means, and said controller means is configured to change a state of an indicator from a particular player state to an off state when a number of indicating means in said particular player state exceeds said predetermined number.

12. A method for playing a game between a first player and a second player using a three-by-three array of nine spaces, said method comprising the steps of:

a) displaying a first initial player indicator at one of said spaces;

b) displaying a first subsequent player indicator at another of said spaces;

c) displaying a second initial player indicator at another of said spaces;

d) displaying a second subsequent player indicator at another of said spaces;

e) displaying a third initial player indicator at another of said spaces;

f) displaying a third subsequent player indicator at another of said spaces;

g) displaying a fourth initial player indicator at another of said spaces;

h) ceasing to display said first initial player indicator responsive to displaying said fourth initial player indicator;

i) displaying a fourth subsequent player indicator at another of said spaces;

j) ceasing to display said first subsequent player indicator responsive to displaying said fourth subsequent player indicator; and k) Repeating steps a–j one at a time until one of a first set of indicators corresponding to said initial player or a second set of indicators corresponding to said subsequent player is linearly arranged within said array.

* * * * *